US007534166B2

(12) United States Patent
Morita

(10) Patent No.: US 7,534,166 B2
(45) Date of Patent: May 19, 2009

(54) CHEMICAL MECHANICAL POLISHING APPARATUS

(75) Inventor: Tomotake Morita, Kanagawa (JP)

(73) Assignee: NEC Electronics Corporation, Kawasaki, Kanagawa (JP)

( * ) Notice: Subject to any disclaimer, the term of this patent is extended or adjusted under 35 U.S.C. 154(b) by 0 days.

(21) Appl. No.: 11/905,625

(22) Filed: Oct. 2, 2007

(65) Prior Publication Data

US 2008/0153400 A1 Jun. 26, 2008

(30) Foreign Application Priority Data

Mar. 10, 2006 (JP) ..... 2006-271582

(51) Int. Cl.
*B24B 29/00* (2006.01)

(52) U.S. Cl. ..... 451/285; 451/44; 451/443; 451/65

(58) Field of Classification Search ..... 451/41, 451/44, 56, 443, 285, 287, 290, 65, 66, 242, 451/246, 254, 258
See application file for complete search history.

(56) References Cited

U.S. PATENT DOCUMENTS 6,102,777 A * 8/2000 Duescher et al. ..... 451/36
6,234,879 B1 * 5/2001 Hasegawa et al. ..... 451/44
6,267,649 B1 * 7/2001 Lai et al. ..... 451/44
6,290,577 B1 * 9/2001 Shendon et al. ..... 451/41
6,935,932 B2 * 8/2005 Kimura et al. ..... 451/44
2002/0119613 A1 * 8/2002 Yang et al. ..... 438/200

FOREIGN PATENT DOCUMENTS

JP 2001-345298 12/2001

* cited by examiner

*Primary Examiner*—Eileen P. Morgan
(74) *Attorney, Agent, or Firm*—McGinn IP Law Group, PLLC

(57) ABSTRACT

An edge section of a wafer can be polished, and at same time, a polishing surface of a polishing member can be dressed by a dresser mechanism. A polishing member has annular concave trenches, which are coaxially formed in the front surface thereof, and at least an inner surface of the concave trenches is composed of an inclined polishing surface for polishing an edge section of the wafer, and a wafer pressing mechanism presses the edge section of the wafer against the inner surfaces in at least one side of the concave trench of the polishing member, and a dresser mechanism dresses at least the inner surfaces in at least one side of the concave trench of the polishing member.

7 Claims, 6 Drawing Sheets

CHEMICAL MECHANICAL POLISHING APPARATUS

This application is based on Japanese patent application No. 2006-271582, the content of which is incorporated hereinto by reference.

BACKGROUND

1. Technical Field

The present invention relates to a chemical mechanical polishing (CMP) apparatus that is capable of polishing a wafer by a chemical mechanical polishing (CMP) process, and in particular relates to a CMP apparatus that is capable of polishing an edge section of a boundary between a front surface and a circumference surface of a disc-shaped wafer.

2. Related Art

Currently, a CMP apparatus is utilized in a manufacture of a semiconductor device. Such CMP apparatus includes a turn table, on which a CMP pad is detachably mounted. A semiconductor wafer, which is in manufacture of semiconductor devices therein and serves as a workpiece, is pressed against a front surface of a CMP pad that is actuated to be rotated together with the turn table.

In such case, the semiconductor wafer reciprocates along a radial direction of the CMP pad. Moreover, a slurry is supplied onto the front surface of the CMP pad. Further, the front surface of the CMP pad is dressed with a dresser, which also reciprocates along a radial direction.

In the manufacturing process of semiconductor devices, film depositions and micro-fabrications are repeated. In depositions of layer films, layer films are also formed on inclined sections and/or round sections in vicinity of a circumference section of a semiconductor wafer. Improvements in clamp rings employed in the deposition process achieve an improvement in a prevention for depositions of films onto a side surface and/or a back surface of a semiconductor wafer.

However, the circumference portion of the semiconductor wafer is in contact with a cassette for semiconductor wafers, causing an adhesion of a contaminant due to creations of contaminants in the contacting spots. When layer films are formed at such contacting spots, the contaminants causes a generation of flaking off.

Thus, a countermeasure for the above-described flaking-off is required in the manufacturing process for the semiconductor devices. To solve the problem, as shown in FIG. 6, an edge polishing apparatus 10 for polishing an edge of a circumference section of a semiconductor wafer W is proposed (see, for example, Japanese Laid-Open Patent No. 2001-345,298).

However, the present inventor has recognized that in the edge polishing apparatus 10 described in the above-described Japanese Laid-Open Patent No. 2001-345,298, a polishing pad 12 supported by a turn table 11 is continuously in contact with the circumference section of the semiconductor wafer W.

Thus, it is constitutively difficult to perform a dressing the polishing pad 12 that is in an operation for polishing the semiconductor wafer W, simultaneously with the polishing.

Therefore, the surface of the polishing pad 12 may be crushed by the pressure, or a clogging with a polishing scum may be caused. Such case causes an unstable rate of an edge polishing, which is an intended purpose in the CMP process, causing an impossible removal of the layer film from the circumference section of the semiconductor wafer W.

In order to prevent such problem, for example, it is considered that an in creased processing time with the edge polishing apparatus 10 is employed. However, this also causes a decreased productivity of the semiconductor devices, causing increased wear and tear in the edge polishing apparatus.

SUMMARY

In one embodiment, there is provided a chemical mechanical polishing (CMP) apparatus, which is capable of polishing an edge section of a boundary between a front surface and a circumference surface of a disc-shaped wafer, comprising: a disc-shaped polishing member rotatably supported by a shaft; a wafer pressing mechanism that is capable of retaining the wafer and pressing the wafer against the polishing member; and a dresser mechanism that is capable of dressing the polishing member at a location, which is different from a location where the wafer pressing mechanism press the wafer, wherein the polishing member includes annular concave trenches coaxially formed in a front surface of the polishing member, wherein at least one of inner surfaces of the concave trench is composed of an inclined polishing surface, which is capable of polishing an edge section of the wafer, wherein the wafer pressing mechanism is capable of pressing the edge section of the wafer against at least one of inner surfaces of the concave trench of the polishing member, and wherein the dresser mechanism is at least capable of dressing the inner surface of the concave trench, against which the edge section of the polishing member is pressed.

Therefore, in the CMP apparatus of the present invention, the edge section of the wafer can be polished with the polishing surface composed of the inner surface the polishing member having the concave trench, and at same time, such polishing surface of the polishing member can be dressed by the dresser mechanism.

A turn table of the present invention is a turn table of the CMP apparatus of the present invention, in which a front surface of the turn table is formed to have a geometry, by which the CMP pad forms the concave trench.

A pad jig of the present invention is a pad jig of the CMP apparatus of the present invention, in which a front surface of the pad jig is formed to have a geometry, by which the CMP pad forms the concave trench.

A CMP pad of the present invention is a CMP pad of the CMP apparatus of the present invention, in which the concave trench is formed in a front surface of the CMP pad.

Since the edge section of the wafer is polished, and at the same time, the dressing can be performed over the polishing surface of the polishing member by the dresser mechanism in the CMP apparatus of the present invention, while preventing a clogging of the polishing pad, the edge-polishing of the wafer can be achieved with an improved efficiency.

BRIEF DESCRIPTION OF THE DRAWINGS

The above and other objects, advantages and features of the present invention will be more apparent from the following description of certain preferred embodiments taken in conjunction with the accompanying drawings, in which.

DETAILED DESCRIPTION

The invention will be now described herein with reference to illustrative embodiments. Those skilled in the art will recognize that many alternative embodiments can be accomplished using the teachings of the present invention and that the invention is not limited to the embodiments illustrated for explanatory purposed.

Figure 1:
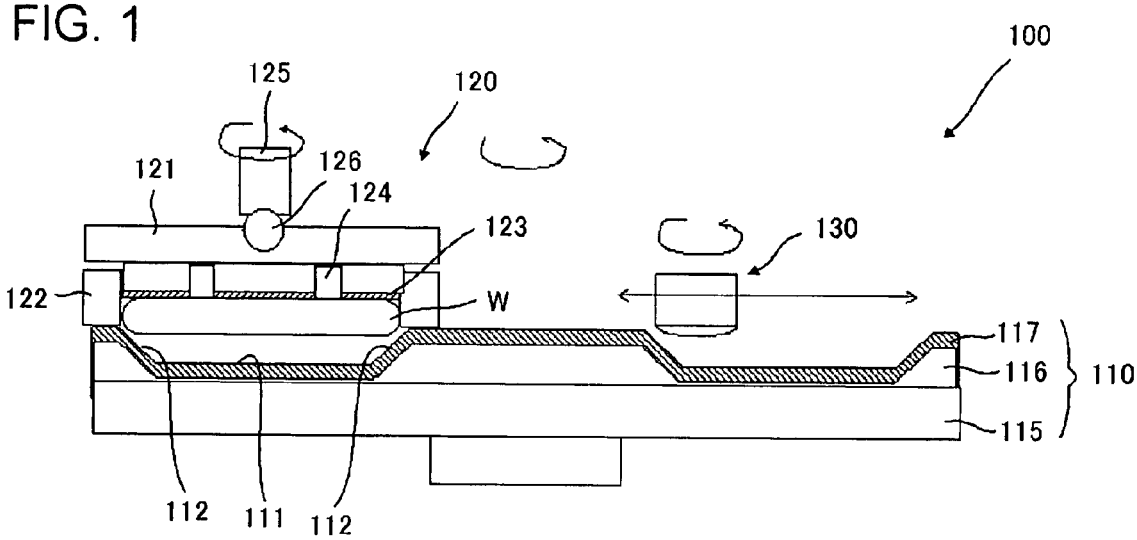
FIG. 1 is a schematic front vertical sectional view, showing an internal structure of a CMP apparatus of a first embodiment according to the present invention.
Figure 2:
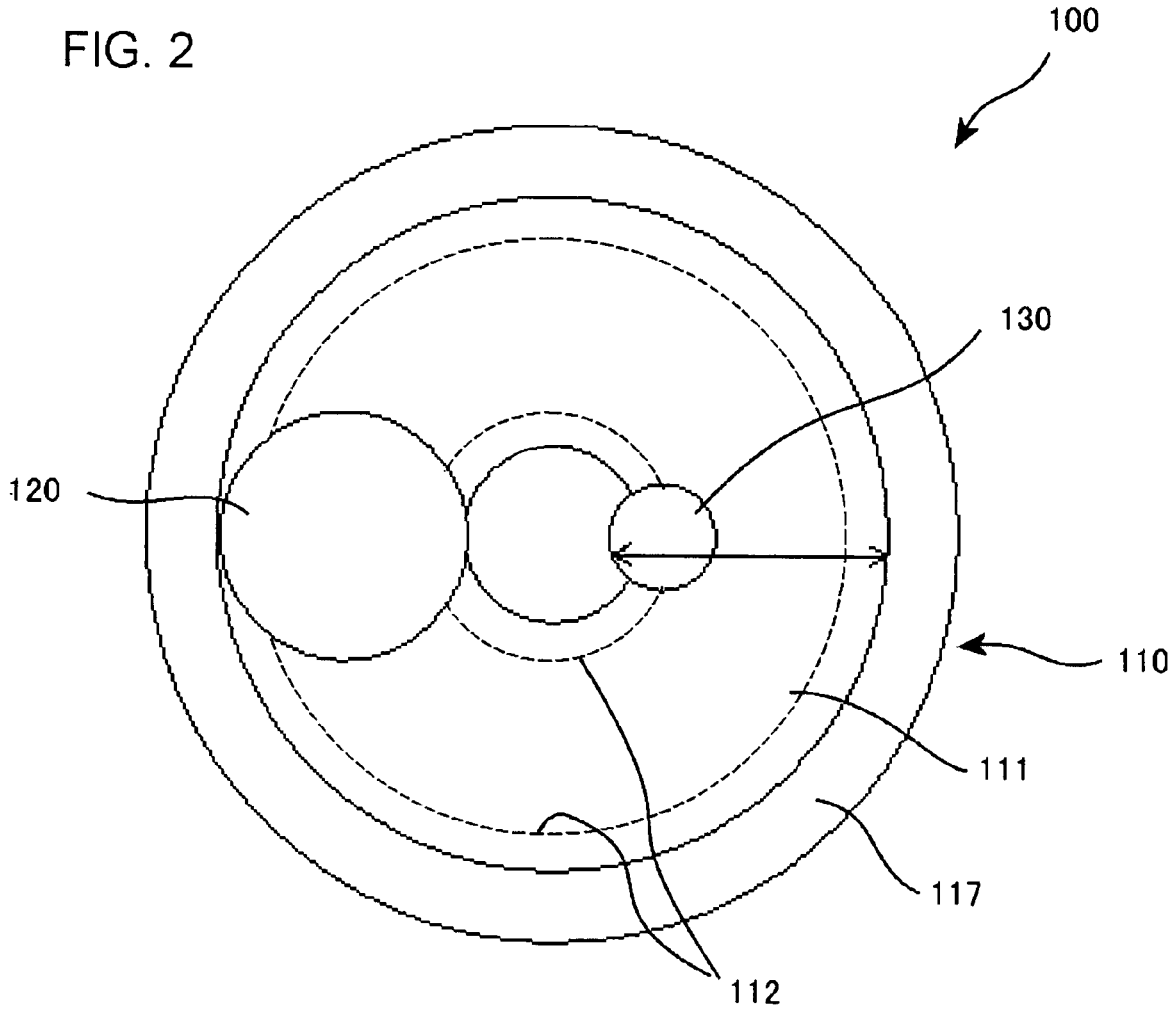
FIG. 2 is a schematic plan view, showing the structure of the CMP apparatus.

A first embodiment of the present invention will be described below, in reference to FIG. 1 and FIG. 2. A CMP apparatus 100 of the present embodiment is capable of polishing an edge section of a boundary between a front surface and a circumference surface of a disc-shaped semiconductor wafer W.

Thus, the CMP apparatus 100 includes a disc-shaped polishing member 110 that is rotatably supported by a shaft, a wafer pressing mechanism 120 that is capable of retaining the semiconductor wafer W and pressing thereof against a polishing member 110, a dresser mechanism 130 that is capable of dressing the polishing member 110 at a location, which is different from a location where the wafer pressing mechanism 120 presses the wafer, and a slurry feed mechanism (not shown) that is capable of supplying a slurry to a central portion in a front surface of the polishing member 110.

Such polishing member 110 has annular concave trenches 111, which are coaxially formed in the front surface thereof, and at least an inner surface 112 of the concave trenches 111 is composed of an inclined polishing surface for polishing an edge section of the semiconductor wafer W.

The wafer pressing mechanism 120 presses the edge section of the semiconductor wafer W against the inner surfaces 112 in both sides of the concave trench 111 of the polishing member 110. The dresser mechanism 130 dresses at least the inner surfaces 112 in both sides of the concave trench 111 of the polishing member 110.

More specifically, the polishing member 110 includes a disc-shaped turn table 115, a pad jig 116 mounted on a front surface of the turn table 115 and a CMP pad 117 mounted on a front surface of the pad jig 116.

The pad jig 116 is fixed onto the turn table 115 to form an integral member. The CMP pad 117 is detachably mounted on the pad jig 116. Then, the front surface of pad jig 116 is formed to have a geometry, by which the CMP pad 117 forms the concave trenches 111.

In addition to above, the wafer pressing mechanism 120 is formed similarly as the conventional product. More specifically, the wafer pressing mechanism 120 includes a disc-shaped holder body 121 rotatably supported by a shaft, an annular retainer 122, slidably mounted by the holder body 121 and supporting the semiconductor wafer W on the circumference surface thereof, a backing film 123 adhered onto a lower surface of the holder body 121, a rotating shaft 125 supporting the holder body 121, a joint mechanism 126 connecting the holder body 121 with the rotating shaft 125, and the like. Further, the holder body 121 is provided with air holes 124 for chucking the semiconductor wafer W formed therein.

The wafer pressing mechanism 120 presses the semiconductor wafer W against polishing member 110 while rotating the semiconductor wafer W in the CMP apparatus 100 of the present embodiment, similarly as in the conventional apparatus, but on the other hand, unlikely as the conventional apparatus, the wafer pressing mechanism 120 does not cause a reciprocation of the semiconductor wafer W along a radial direction of the polishing member 110. In addition to above, the directions of rotations of the polishing member 110 and the wafer pressing mechanism 120 may be the same, or different.

In addition, the dresser mechanism 130 is formed similarly as the conventional apparatus, but on the other hand, unlikely as the conventional apparatus, is formed to dress the inner surfaces 112 of the inclined concave trenches 111, instead of a flat upper surface of the polishing member 110.

Thus, the dresser mechanism 130 is formed to have a structure, which allows moving in, for example, the vertical direction corresponding to the inner surfaces 112 of the concave trench 111, in addition to the reciprocation along the radial direction of the polishing member 110.

In the CMP apparatus 100 of the present embodiment having the configuration as described above, the edge section of the semiconductor wafer W is polished with a polishing surface composed of the inner surfaces 112 in both sides of the concave trench 111 of the polishing member 110.

At the same time, the polishing surface composed of the inner surfaces 112 in both sides of the concave trench 111 of the polishing member 110 is dressed by the dresser mechanism 130. Thus, the edge-polishing of the semiconductor wafer W can be achieved with an improved efficiency, while preventing a clogging of the polishing member 110.

Moreover, the polishing of the edge section of the semiconductor wafer W is simultaneously achieved at two locations by virtue of the inner surfaces 112 in both sides of the concave trench 111 of the polishing member 110. Thus, the doubling of the polishing efficiency can be achieved. Further, unnecessary stress in the transverse direction exerted on the semiconductor wafer W or the wafer pressing mechanism 120 can be avoided.

In addition, the CMP apparatus 100 includes a unit for recovering the surface of the CMP pad 117 after the CMP pad table 117 surface is crashed. By having the diameter of the turn table 115 that is equal to or larger than double of the diameter of the semiconductor wafer W, and by performing a dressing of the surface of the CMP pad 117 with the dresser mechanism 130 in a working area, which is not the areas where the CMP pad 117 contacts with the semiconductor wafer W, the recovery of the crashed CMP pad 117 can be achieved.

In addition, a pad surface control is performed in a region where no interference with the action of the wafer pressing mechanism 120 is occurred during the processing of the semiconductor wafer W or in an interval between the processing operations for the semiconductor wafer W. The use of the dresser mechanism 130 cause a removal of the material clogged in the surface of the CMP pad 117 and/or a roughening of the surface. The operating conditions of the dresser mechanism 130 can be defined according to the characteristic of the employed pad. When a CMP pad of a hard polyurethane is employed, a structure having diamond particles mounted thereon is desirable. When a CMP pad of a unwoven fabric impregnated with polyurethane is employed, a structure having hard nylon brush mounted thereon is desirable. For the removal of the clogged materials, the apparatus may include a suction mechanism, an ultrasonic cleaning mechanism, or a rinsing mechanism with a high pressure water.

Further, in the CMP apparatus 100 of the present embodiment, the pad jig 116 interposed between the turn table 115 and the CMP pad 117 forms the concave trench 111 of the polishing member 110.

Thus, the conventionally employed products can be utilized for the turn table 115 and the CMP pad 117. In other words, the CMP apparatus 100 of the present embodiment can be obtained by mere additionally installing the pad jig 116 in the conventional CMP apparatus.

In particular, since the conventional products can be utilized for the CMP pad 117 that is consumable materials, an increase of the running cost for achieving the polishing member 110 having the concave trench 111 can be avoided.

The present invention is not limited to the present embodiment, and various modification is also included in the present invention without departing from the scope and the spirit of the invention. For example, the exemplary implementation of the CMP apparatus 100 that is capable of pressing one semiconductor wafer W against the polishing member 110 by employing a single wafer pressing mechanism 120 in the above-described form.

Figure 3:
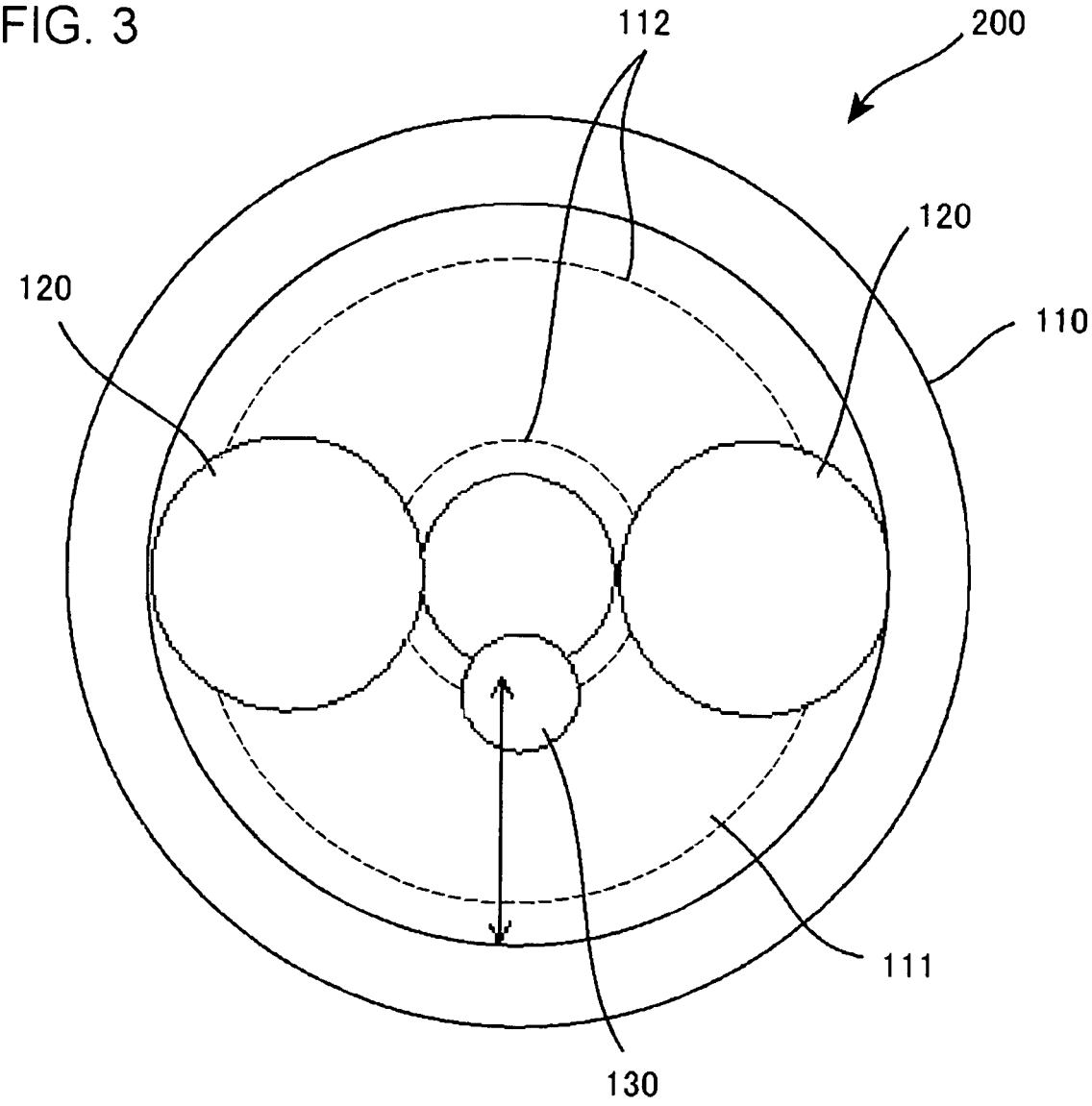
FIG. 3 is a schematic plan view, showing a structure of a CMP apparatus of a modified embodiment according to the present invention.

Alternatively, as a CMP apparatus 200 illustrated in FIG. 3, a plurality of semiconductor wafers W may be pressed against the polishing member 110 with a plurality of wafer pressing mechanisms 120. This configuration can achieve a further improved operational efficiency in the CMP process.

Further, the above-described embodiment illustrates the dressing of the member with a single dresser mechanism 130, which is movable over a pair of inner surfaces 112 of the concave trench 111 of the polishing member 110. Alternatively, a pair of inner surfaces 112 of the polishing member 110 may be dressed with a pair of dresser mechanisms 130, respectively (not shown).

Figure 4:
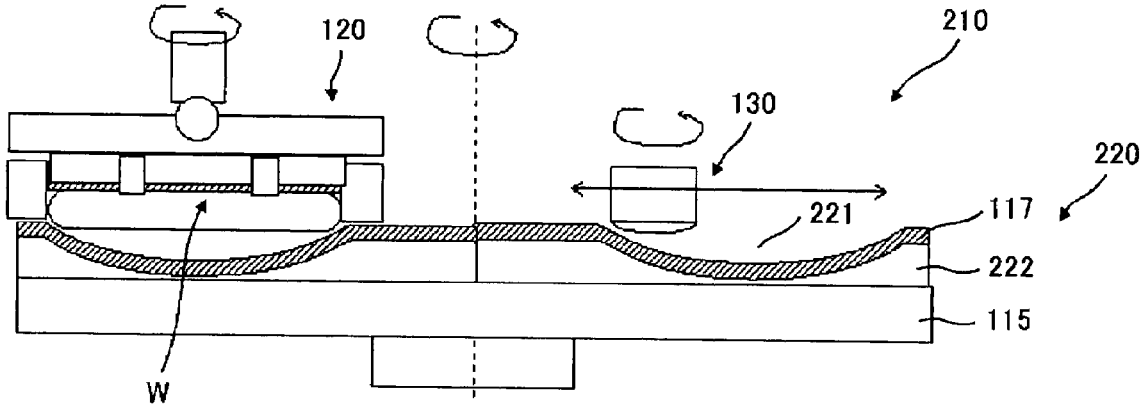
FIG. 4 is a schematic front vertical sectional view, showing an internal structure of a CMP apparatus of another modified embodiment according to the present invention.

Further, the above-described embodiment illustrates that the concave trench 111 of the polishing member 110 is formed to have the inclined inner surface 112 and the bottom surface, the cross-sectional geometry of which is a clear inverse trapezoid. Alternatively, as a CMP apparatus 210 illustrated in FIG. 4, a concave trench 221 of a polishing member 220 may be formed to have an arc-shaped cross-sectional geometry.

In this case, a chucking of the CMP pad 117 to a pad jig 222 is more easily achieved. Further, since it is sufficient to achieve the dressing by reciprocating the dresser mechanism 130 along the arc-shaped path, the polishing member 220 can be more easily dressed.

Further, the above-described embodiment illustrates that the entire area of the front surface of the polishing member 110 is utilized as the polishing surface. Alternatively, only the section of the inner surfaces 112 of the concave trench 111 may be utilized as the polishing surface. In such case, for example, a larger and a smaller annular CMP pads may be formed in advance, and these may be pasted on the inner surfaces 112 of the concave trench 111, respectively (not shown).

Further, the above-described embodiment illustrates that the concave trench 111 is formed in the front surface of CMP pad 117 by mounting the pad jigs 116 having different geometry on the front surface of the existing turn table 115.

Alternatively, the front surface of turn table may be formed to have a geometry, by which the CMP pad 117 forms the concave trench 111 (not shown). Further, the CMP pad may be formed to have a geometry, which includes the concave trench 111 in the front surface thereof (not shown).

Figure 5:
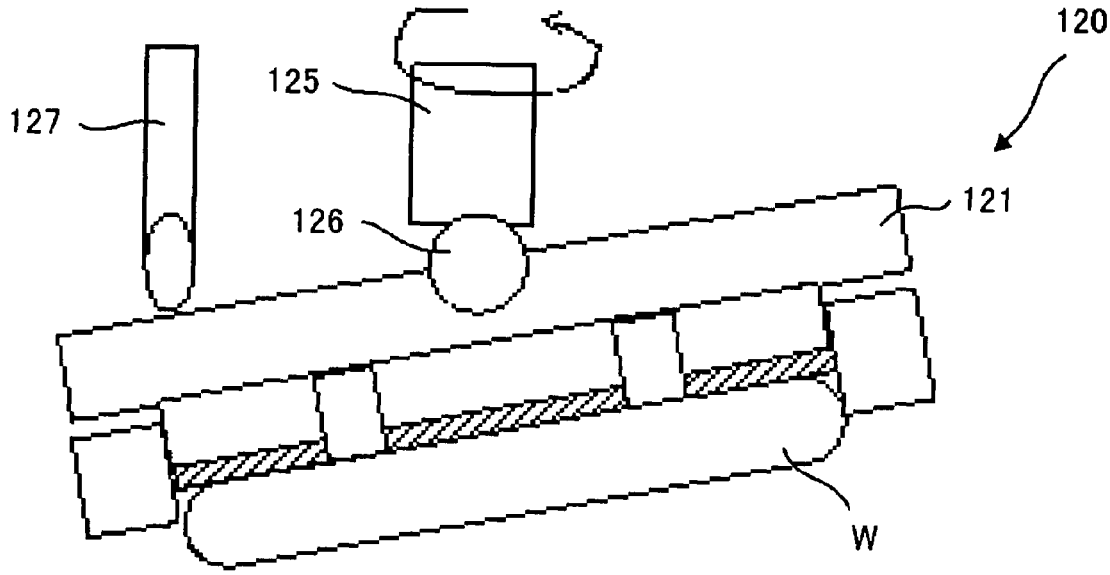
FIG. 5 is a schematic front vertical sectional view, showing a main part of a CMP apparatus of further modified embodiment according to the present invention.
Figure 6:
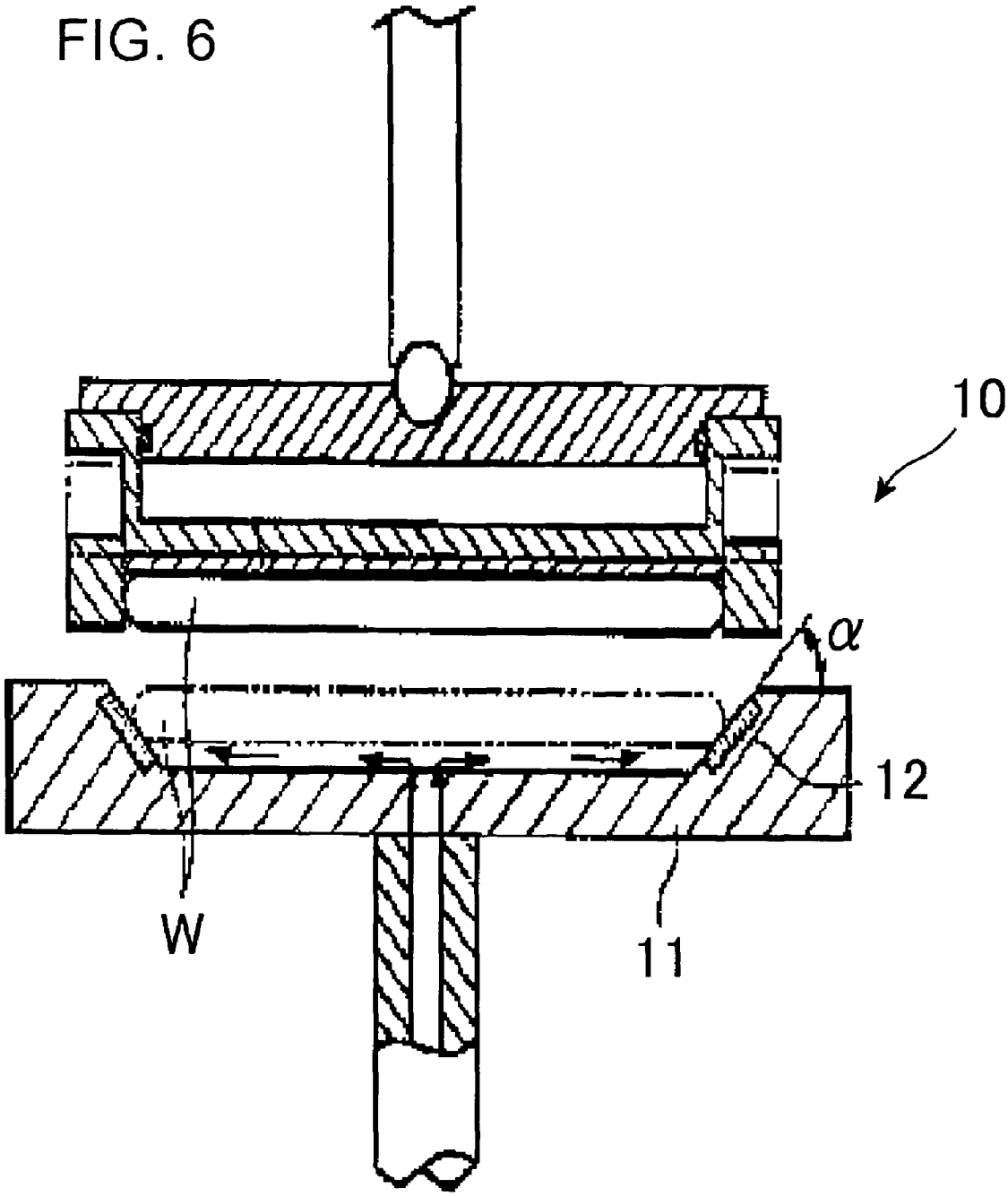
FIG. 6 is a schematic side view, showing an internal structure of a conventional CMP apparatus.

Further, the above-described embodiment illustrates that the polishing member 110 is formed to have different geometry in order to polish the edge section of the semiconductor wafer W. Alternatively, as shown in FIG. 5, the wafer pressing mechanism 120 may rotatably support the semiconductor wafer W by a shaft while the wafer being tilted relative to the polishing member 110, and may press the edge section against the polishing member (not shown).

More specifically, the holder body 121 of the wafer pressing mechanism 120 is supported by a rotating shaft 125 through a joint mechanism 126. Thus, the upper surface of the holder body 121 is partially pressed against the pressing unit material 127 from the upper direction, so that the semiconductor wafer W is driven to be rotated in a tilted position.

It is apparent that the present invention is not limited to the above embodiment, and may be modified and changed without departing from the scope and spirit of the invention.

What is claimed is:

1. A chemical mechanical polishing (CMP) apparatus for polishing an edge section of a boundary between a front surface and a circumference surface of a disc-shaped wafer, comprising:

a disc-shaped polishing member rotatably supported by a shaft;

a wafer pressing mechanism for retaining said wafer and pressing said wafer against said polishing member; and a dresser mechanism for dressing said polishing member at a location, which is different from a location where said wafer pressing mechanism presses said wafer, wherein said polishing member includes at least one annular concave trench coaxially formed on a front surface of said polishing member, wherein at least one inner surface of said concave trench is composed of an inclined polishing surface for polishing an edge section of said wafer, said wafer pressing mechanism pressing the edge section of said wafer against at least one inner surface of said concave trench of said polishing member, and wherein said dresser mechanism dresses the inner surface of said concave trench, against which said edge section of said polishing member is pressed.

2. The CMP apparatus as set forth in claim 1, further comprising a plurality of said wafer pressing mechanisms for of pressing said plurality of wafers against a plurality of locations in said polishing member, respectively.

3. The CMP apparatus as set forth in claim 1, wherein said polishing member includes a disc-shaped turn table and a CMP pad mounted on a front surface of said turn table, and wherein a front surface of said turn table is formed to have a geometry, by which said CMP pad forms said concave trench.

4. The CMP apparatus as set forth in claim 1, wherein said polishing member includes a disc-shaped turn table, a pad jig mounted on a front surface of said turn table, and a CMP pad mounted on a front surface of said pad jig, and wherein a front surface of said pad jig is formed to have a geometry, by which said CMP pad forms said concave trench.

5. The CMP apparatus as set forth in claim 1, wherein said polishing member has a disc-shaped turn table and a CMP pad mounted on a front surface of said turn table, and wherein said concave trench is formed in a front surface of said CMP pad.

6. The CMP apparatus as set forth in claim 1, wherein said wafer pressing mechanism presses an edge section of said wafer against said inner surface in both sides of said concave trench of said polishing member, and wherein said dresser mechanism dresses at least said inner surface in both sides of said concave trench of said polishing member.

7. The CMP apparatus as set forth in claim 1, wherein said wafer pressing mechanism rotatably supports said wafer by a shaft while said wafer is inclined relative to said polishing member, and is capable of pressing said edge section against said polishing member.

* * * * *